US007049567B2

(12) United States Patent
Kim

(10) Patent No.: US 7,049,567 B2
(45) Date of Patent: May 23, 2006

(54) WALL-MOUNTED TYPE MICROWAVE OVEN HAVING AN EXHAUST MECHANISM

(75) Inventor: Gong-Soo Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/279,885

(22) Filed: Oct. 25, 2002

(65) Prior Publication Data

US 2004/0000547 A1 Jan. 1, 2004

(30) Foreign Application Priority Data

Jun. 29, 2002 (KR) ..... 2002-37607

(51) Int. Cl.
*H05B 6/80* (2006.01)

(52) U.S. Cl. ..... 219/757; 219/702; 126/299 D; 126/21 A

(58) Field of Classification Search ..... 219/757, 219/681, 702, 400; 126/299 D, 299 R, 21 A, 126/273 A
See application file for complete search history.

(56) References Cited

U.S. PATENT DOCUMENTS 4,786,774 A * 11/1988 Kaminaka ..... 219/757
5,981,929 A * 11/1999 Maeda et al. ..... 219/757
6,218,654 B1 * 4/2001 Braunisch ..... 219/757
6,242,725 B1 * 6/2001 Murata et al. ..... 219/757

FOREIGN PATENT DOCUMENTS

JP 2001-004151 1/2001

* cited by examiner

*Primary Examiner*—Philip H. Leung
(74) *Attorney, Agent, or Firm*—Staas & Halsey LLP

(57) ABSTRACT

A wall-mounted type microwave oven selectively changes a discharging direction of air from a cooking chamber to the outside of a room and to the inside of the room. The microwave oven includes an oven body having a cooking chamber and an electric component compartment, an exhaust flow path which communicates with a lower portion of the oven body and an upper portion of the oven body to exhaust air existing under the oven body to the outside, a ventilation flow path which communicates with the inside of the cooking chamber and a front air outlet to ventilate the cooking chamber, a communicating flow path which is provided in the oven body and allows the exhaust flow path to communicate with the ventilation flow path, and a path-converting device which is provided in the communicating flow path and selectively discharges the air exhausted from the cooking chamber toward either the front air outlet or the exhaust flow path.

21 Claims, 6 Drawing Sheets

WALL-MOUNTED TYPE MICROWAVE OVEN HAVING AN EXHAUST MECHANISM

CROSS-REFERENCE TO RELATED APPLICATIONS

This application claims the benefit of Korean Patent Application No. 2002-37607 filed on Jun. 29, 2002, in the Korean Industrial Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven which selectively discharges air in a cooking chamber to the outside or to a kitchen space.

2. Description of the Related Art

Generally, a wall-mounted type microwave oven is mounted on a kitchen wall over an oven range, and is designed to carry out a cooking operation and exhaust gas and fumes generated from the oven range disposed therebelow to the outside.

FIG. 1 shows a conventional wall-mounted type microwave oven comprising an oven body 1 having a cooking chamber 2 and a electric component compartment 3, which are isolated from each other by a partition plate 8. The microwave oven is also provided with an exhaust flow path 4 to exhaust gas and fumes generated from an oven range (not shown) disposed therebelow. The exhaust flow path 4 extends from bottoms of the cooking chamber 2 and the electric component compartment 3 to tops thereof through side wall surfaces thereof. The oven body 1 is provided at its upper and rear portion with an exhaust fan 5 which sucks the gas and fumes into the exhaust flow path 4 and discharges them to the outside.

The electric component compartment 3 is provided therein with a cooling fan 6 which cools electrical components mounted therein. The electric component compartment 3 includes a front air inlet 7 at its front and upper portion, which causes outside air to be introduced into the electric component compartment 3 therethrough. The partition plate 8 is disposed between the cooking chamber 2 and the electric component compartment 3, and is formed with a plurality of vent holes 9 to allow the air introduced into the electric component compartment 3 to flow into the cooking chamber 2, thereby ventilating the cooking chamber 2. An upper surface of the cooking chamber 2 is also formed with a plurality of second vent holes 10 at a position opposite to the partition plate 8 to allow the air in the cooking chamber 2 to be exhausted therefrom. The cooking chamber 2 includes a front air outlet 11 at its front and upper portion, which allows the air exhausted from the second vent holes 10 to be exhausted to a kitchen room space therethrough.

However, since the conventional wall-mounted type microwave oven is designed to discharge air, which is circulated in the cooking chamber 2 and then exhausted therefrom, to the kitchen room space, odors and gas generated in the cooking chamber 2 diffuse into the kitchen room space, thereby polluting kitchen room air.

SUMMARY OF THE INVENTION

Accordingly, it is an aspect of the present invention to provide a wall-mounted type microwave oven which selectively changes a discharging direction of air exhausted from a cooking chamber to the outside of a room, and to the inside of the room, according to a user's need.

Additional aspects and advantages of the invention will be set forth in part in the description which follows and, in part, will be obvious from the description, or may be learned by practice of the invention.

To achieve the above and other aspects of the present invention, there is provided a wall-mounted type microwave oven comprising an oven body for mounting in a cooking area and which includes a cooking chamber and an electrical component compartment which are isolated from each other, an exhaust flow path which communicates between a lower portion of the oven body and an upper portion of the oven body to exhaust air existing under the oven body to the outside of the cooking area, a ventilation flow path which communicates between an inside of the cooking chamber and a front air outlet of the oven body to ventilate the cooking chamber, a communicating flow path which is provided in the oven body and communicates between the exhaust flow path and the ventilation flow path, and a path-converting device which is provided in the communicating flow path and selectively discharges air exhausted from the cooking chamber toward either the front air outlet or the exhaust flow path.

The ventilation flow path may include one or more through-holes formed at an upper surface of the cooking chamber, which communicate with the front air outlet. The communicating flow path may be provided over the cooking chamber and allows the front air outlet, the one or more through-holes and the exhaust flow path to communicate with one another.

The path-converting device may comprise a path-converting member which is rotatably provided in the communicating flow path, positioned over the one or more through-holes and has a path-blocking sectional area corresponding to a sectional area of the communicating flow path, and a drive motor which rotates the path-converting member in both forward and reverse directions.

The path-converting member may comprise a path-blocking curved plate having a longitudinal length corresponding to a width of the communicating flow path, and a pair of support portions which extend from corresponding opposite ends of the path-blocking plate toward a rotating axis thereof, so as to have free ends of the support portions be rotatably supported to portions defining the communicating flow path.

A radius of a circle depicted by the path-blocking curved plate may correspond to a height of the communicating flow path.

The one or more through-holes of the cooking chamber may be positioned at an area corresponding to a diameter of the circle depicted by the path-blocking plate.

The drive motor may be installed outside of the communicating flow path, and the path-converting device may further comprise a sector gear coupled to a rotating shaft of the path-converting member, and a pinion coupled to a shaft of the drive motor and which engages with the sector gear to reduce a rotational speed of the drive motor and transmit a rotating force of the drive motor to the path-converting member.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
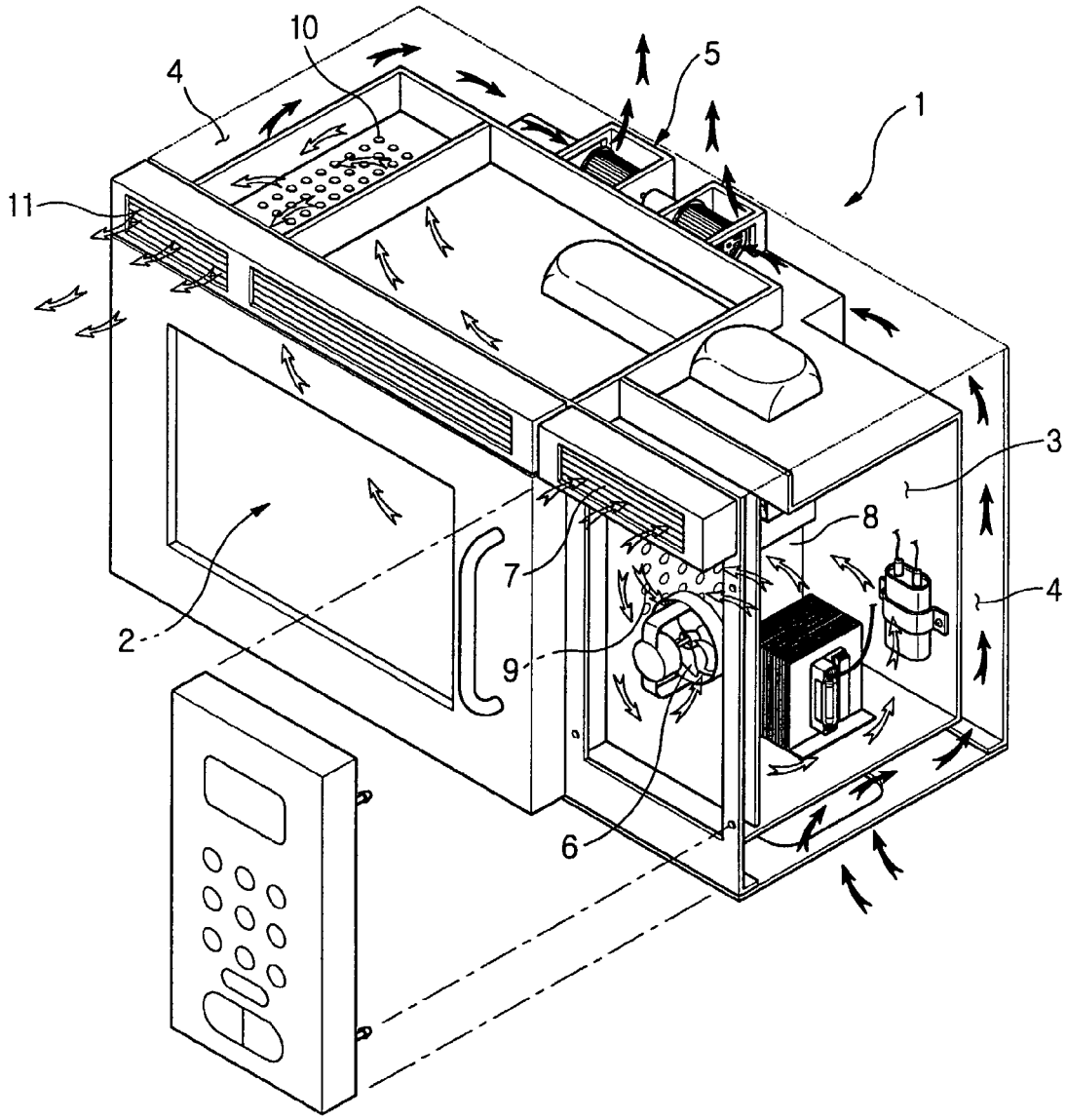
FIG. 1 (Prior Art)
FIG. 1 is a perspective view of a conventional wall-mounted type microwave oven and its air circulation system.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
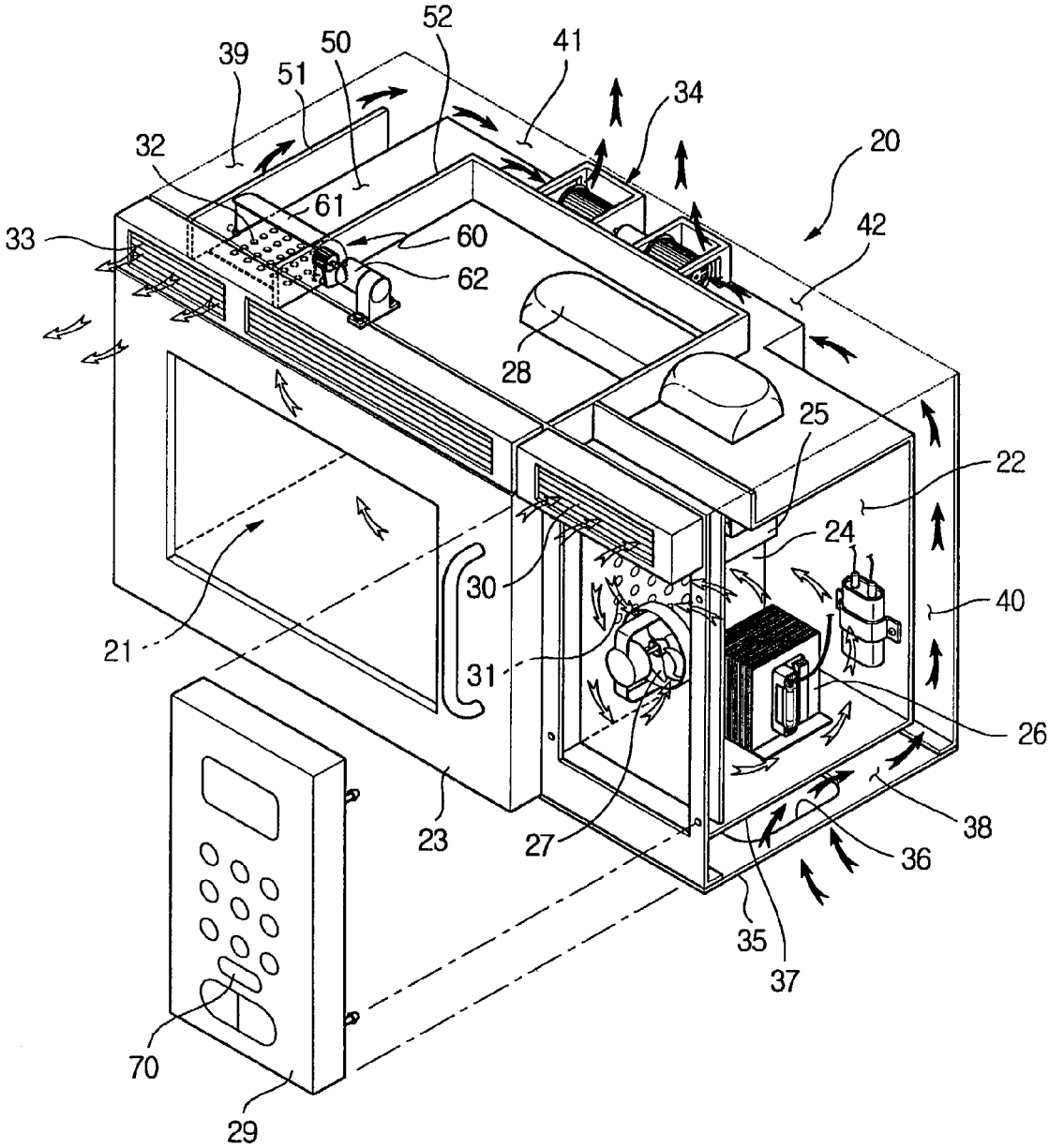
FIG. 2 is a perspective view of a wall-mounted type microwave oven and its air circulating system according to an embodiment of the present invention.

FIG. 2 shows a wall-mounted type microwave oven according to an embodiment of the present invention. The microwave oven includes an oven body 20 having a cooking chamber 21 for receiving food to be cooked therein, and a electric component compartment 22 in which various electrical components are mounted, that are isolated from each other.

The cooking chamber 21 is provided at its front with a door 23, which is hingedly coupled thereto to be opened and closed. The electric component compartment 22 is isolated from the cooking chamber 21 by a partition plate 24. The electric component compartment 22 is provided therein with the electrical components, including a magnetron 25 which supplies high-frequency electromagnetic waves into the cooking chamber 21, a high voltage transformer 26 which applies a high voltage to the magnetron 25, and a cooling fan 27 which cools the electric component compartment 22. The magnetron 25 is mounted on an upper portion of a wall defining the electric component compartment 22, and the high voltage transformer 26 is mounted on a bottom surface of the electric component compartment 22. A waveguide 28 is disposed on a top of both the cooking chamber 21 and the electric component compartment, and guides the high frequency electromagnetic waves supplied from the magnetron 25 into the cooking chamber 21. The electric component compartment 22 is provided at its front face with a control panel 29 which includes a plurality of buttons to control various functions of the microwave oven, and a display which displays operational conditions of the microwave oven.

A ventilation flow path of the microwave oven allows outside air to be introduced into the electric component compartment 22 and the cooking chamber 21, and then be discharged to the outside, for example, a kitchen room space, to ventilate the electric component compartment 22 and the cooking chamber 21. The ventilation flow path includes a front air inlet 30 which is disposed over the control panel 29 of the oven body 20 and communicates with the electric component compartment 22 to allow outside air to be introduced into the electric component compartment 22 therethrough, and a plurality of vent holes 31 which are formed at the partition plate 24 and allow the air introduced into the electric component compartment 22 through the front air inlet 30 to be introduced into the cooking chamber 21 while cooling the electric component compartment 22. The ventilation flow path further includes a plurality of vent holes 32 formed at an upper surface of the cooking chamber 21, and a front air outlet 33 which is disposed at an upper portion of a front face of the cooking chamber 21 and allows the air in the cooking chamber 21 to be discharged to the kitchen room space therethrough.

Through the ventilation flow path, in response to an operation of the cooling fan 27, outside air is introduced into the electric component compartment 22 through the front air inlet 30 to cool the electric component compartment 22, and then introduced into the cooking chamber 21 through the vent holes 31 of the partition plate 24 to ventilate the cooking chamber 21. Subsequently, the air in the cooking chamber 21 is discharged to the kitchen room space through the vent holes 32 and the front air outlet 33.

An exhaust flow path of the microwave oven, which is constructed to be isolated from the cooking chamber 21 and the electric component compartment 22, allows gas and fumes generated by an oven range (not shown) disposed below the oven body 20 to be exhausted to the outside. That is, the oven body 20 is provided at its upper and rear portion with an exhaust fan assembly 34 which discharges the gas and fumes, introduced into the exhaust flow path, to the outside, for example, the outside of the kitchen room space.

The exhaust flow path comprises intake ports 36 formed at a bottom panel 35 of the oven body 20, a lower path section 38 defined between bottom plates 37 of the cooking chamber 21 and the electric component compartment 22 and a bottom panel 35 of the oven body 20, two rising path sections 39 and 40 vertically disposed beside the cooking chamber 21 and behind the electric component compartment 22 to communicate with the lower path section 38, and two upper path sections 41 and 42 disposed at an upper portion of the oven body 20 to guide gas and fumes, which are introduced through the rising path sections 39 and 40, to the exhaust fan 34. Accordingly, as the exhaust fan 34 is operated, gas and fumes, which are introduced into the oven body 20 through the intake ports 36, are exhausted to the outside of the kitchen room space after flowing through the lower path section 38, the two rising path sections, and the two upper path sections 41 and 42.

The wall-mounted type microwave oven further includes a communicating flow path 50 which directs air discharged from the cooking chamber 21, through the ventilation flow path, to the front air outlet 33 or to the upper path section 41 disposed at a rear portion of the oven body 20. The communicating flow path 50 is provided with a path-converting device 60.

The communicating flow path 50 is disposed between a top panel of the cooking chamber 21 and an outer case (not shown) of the oven body 20. The communicating flow path 50 is isolated from the other space between the top panel of the cooking chamber 21 and the outer case by two parallel guide plates 51 and 52 which extend back and forth along a width of the microwave oven. The communicating flow path 50 is opened at its front and rear ends, so as to have the both ends communicate with the front air outlet 33 and the upper path section 41, respectively. The vent holes 32 of the cooking chamber 21 are formed at an area defined by the parallel guide plates 51 and 52 to communicate with the communicating flow path 50.

Figure 3:
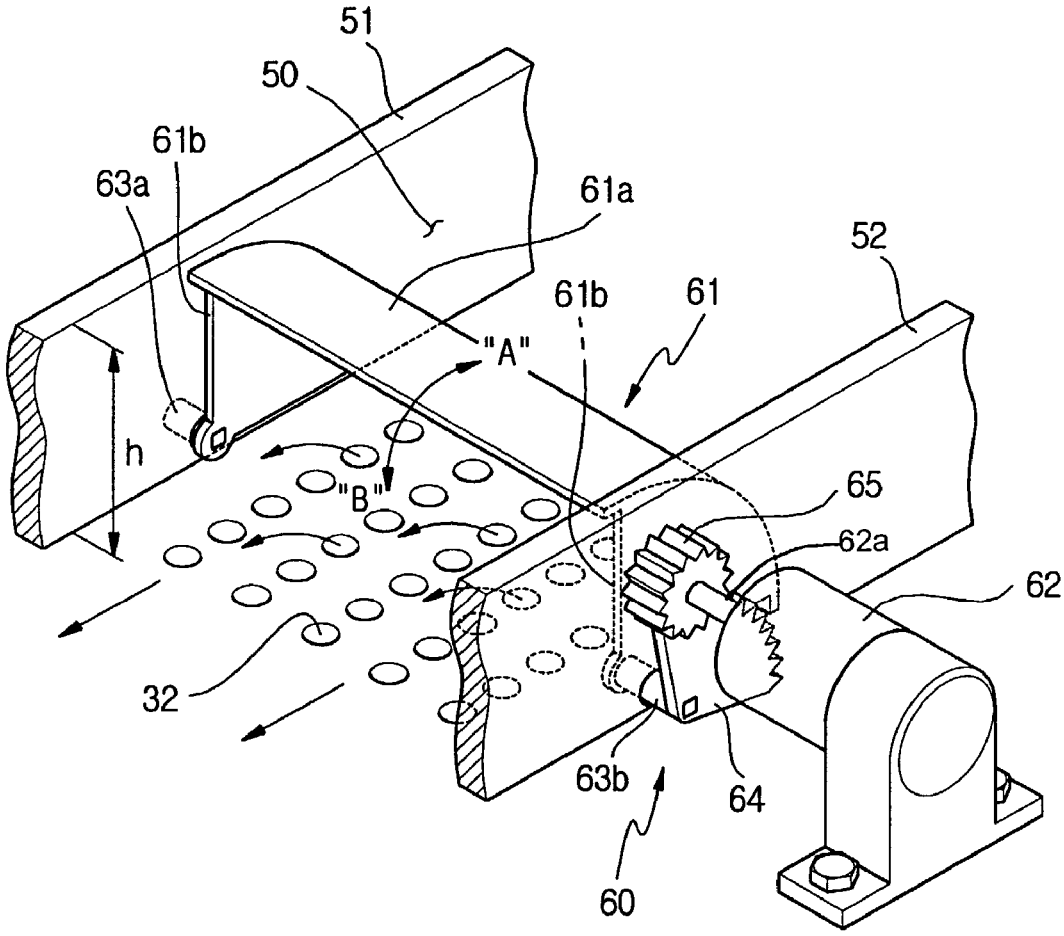
FIG. 3 is a perspective view of a path-converting device of the microwave oven shown in FIG. 2.
Figure 4:
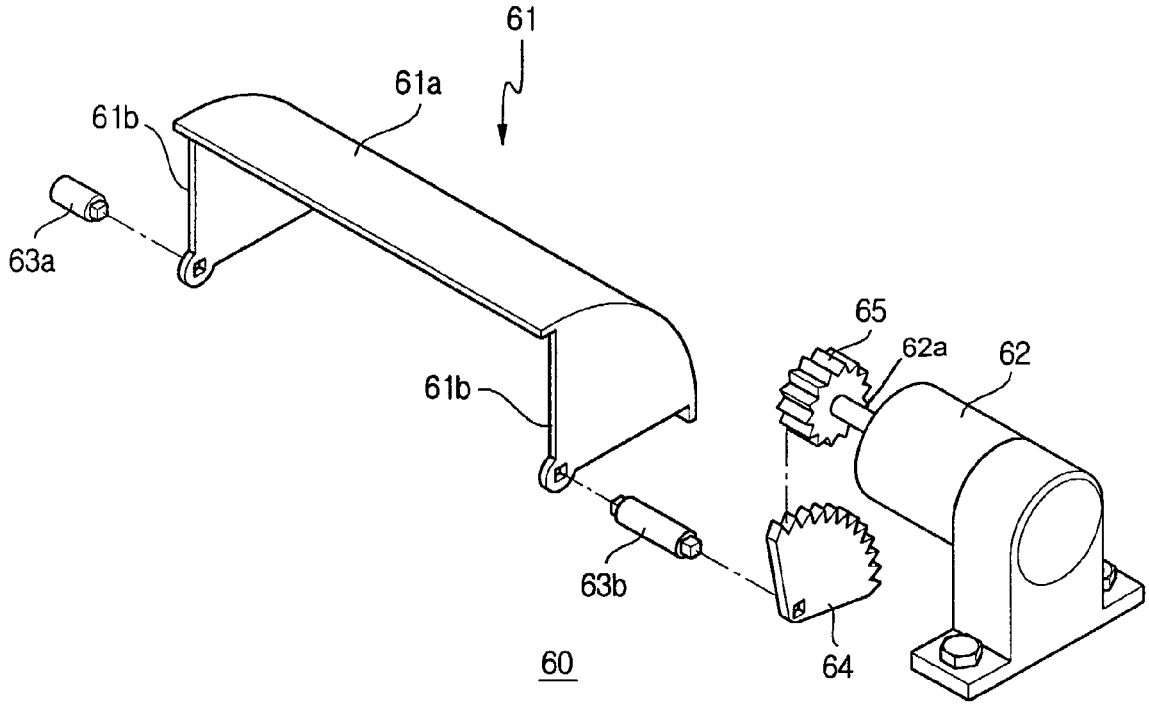
FIG. 4 is an exploded perspective view of the path-converting device shown in FIG. 3.

FIGS. 3 and 4 show the path-converting device 60 of the microwave oven shown in FIG. 2. The path-covering device 60 comprises a path-converting member 61 disposed between the two parallel guide plates 51 and 52 and rotatably supported thereby to be disposed over the vent holes 32 in the communicating flow path 50, a drive motor 62 which rotates the path-converting member 62, and a transmitting unit (described herein below) which reduces a rotational speed of the drive motor 62 and transmits a rotating force of the drive motor 62 to the path-converting member 61.

The path-converting member 61 includes a path-blocking curved plate 61*a* having a radius corresponding to a height "h" of the communicating flow path 50 and a longitudinal length corresponding to a width of the communicating flow path 50. The path-blocking curved plate 61*a* has the same sectional area as that of the communicating flow path 50, when viewed from the front. The path-converting member 61 also includes a pair of sector-shaped support plates 61*b* which extend from corresponding opposite ends of the path-blocking plate 61*a*. The support plates 61*b* are provided with shafts 63*a* and 63*b*, so that the path-converting member 61 is rotatably supported to the guide plates 51 and 52.

In the instant embodiment, a radius of a circle depicted by the path-blocking plate 61*a* corresponds to the height "h" of the communicating flow path 50, and the vent holes 32 of the cooking chamber 21 are positioned at an area corresponding to a diameter of the circle depicted by the path-blocking plate 61*a*. Therefore, all of the vent holes 32 of the cooking chamber 21 communicate with the front air outlet 33 or the upper path section 41, depending on a rotated position of the path-converting member 61.

As shown in FIG. 3, the drive motor 62 which rotates the path-converting member 61 is installed outside the communicating flow path 50. The transmitting unit which reduces a rotational speed of the drive motor 62 and transmits a rotating force thereof to the path-converting member 61, comprises a sector gear 64 which is coupled to the shaft 63*b* of the path-converting member 61 and disposed outside of the guide plate 52, and a pinion 65 which is coupled to a rotating shaft 62*a* of the drive motor 62 and engages with the sector gear 64. Accordingly, where the drive motor 62 is rotated, the rotational speed of the drive motor 62 is reduced by the pinion 65 and the sector gear 64, and the rotating force of the drive motor 62 is transmitted to the path-converting member 61 thereby. To control the path-converting device 60, the control panel 29 of the oven body 20 is provided with a path-converting switch 70, as illustrated in FIG. 2. Consequently, the direction of the ventilation flow path is converted by a forward rotation and a reverse rotation of the drive motor 62, activated by the path-converting switch 70.

Figure 5:
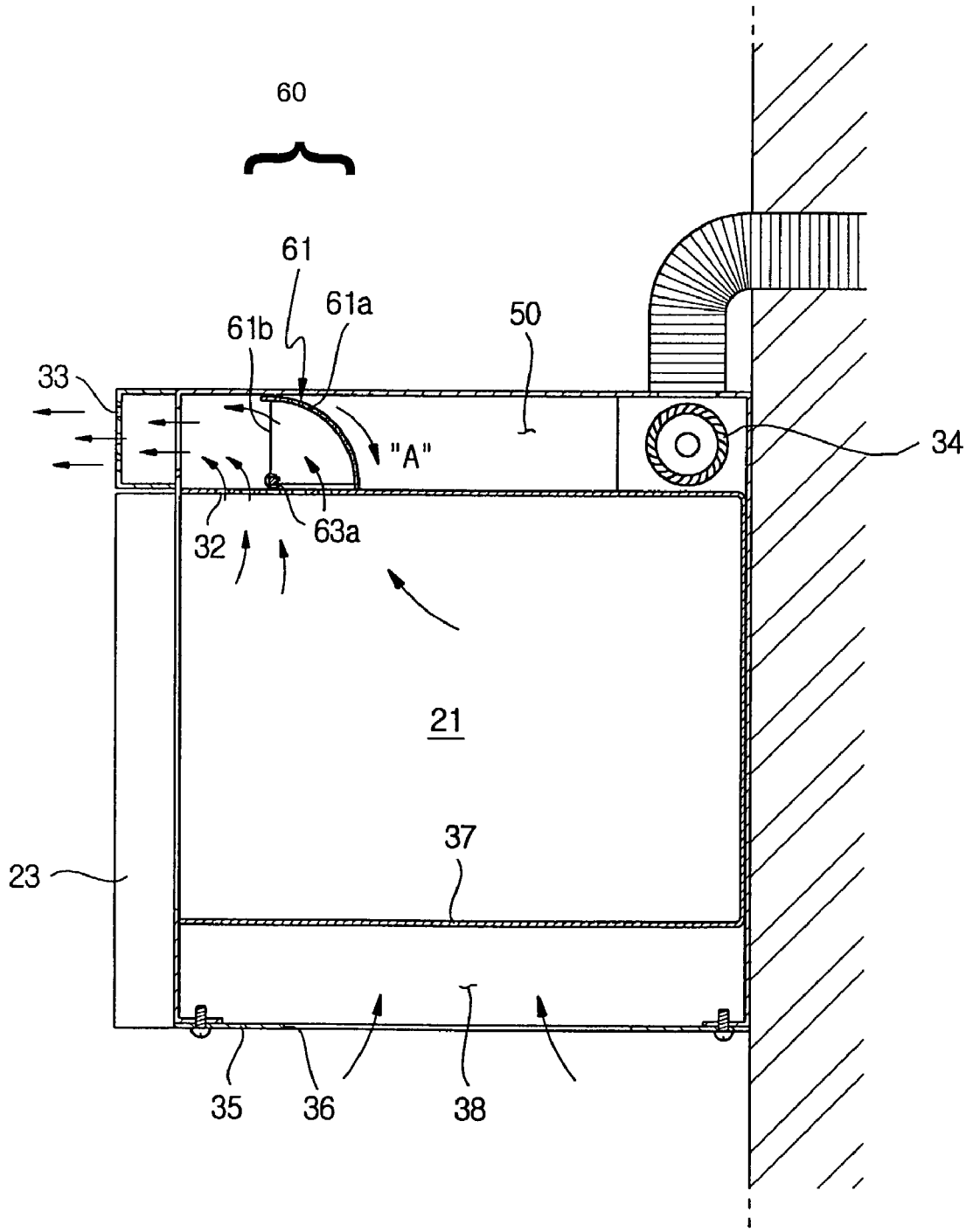
FIG. 5 is a cross-sectional view of the wall-mounted type microwave oven shown in FIG. 2, illustrating air in a cooking chamber being discharged to a front air outlet.
Figure 6:
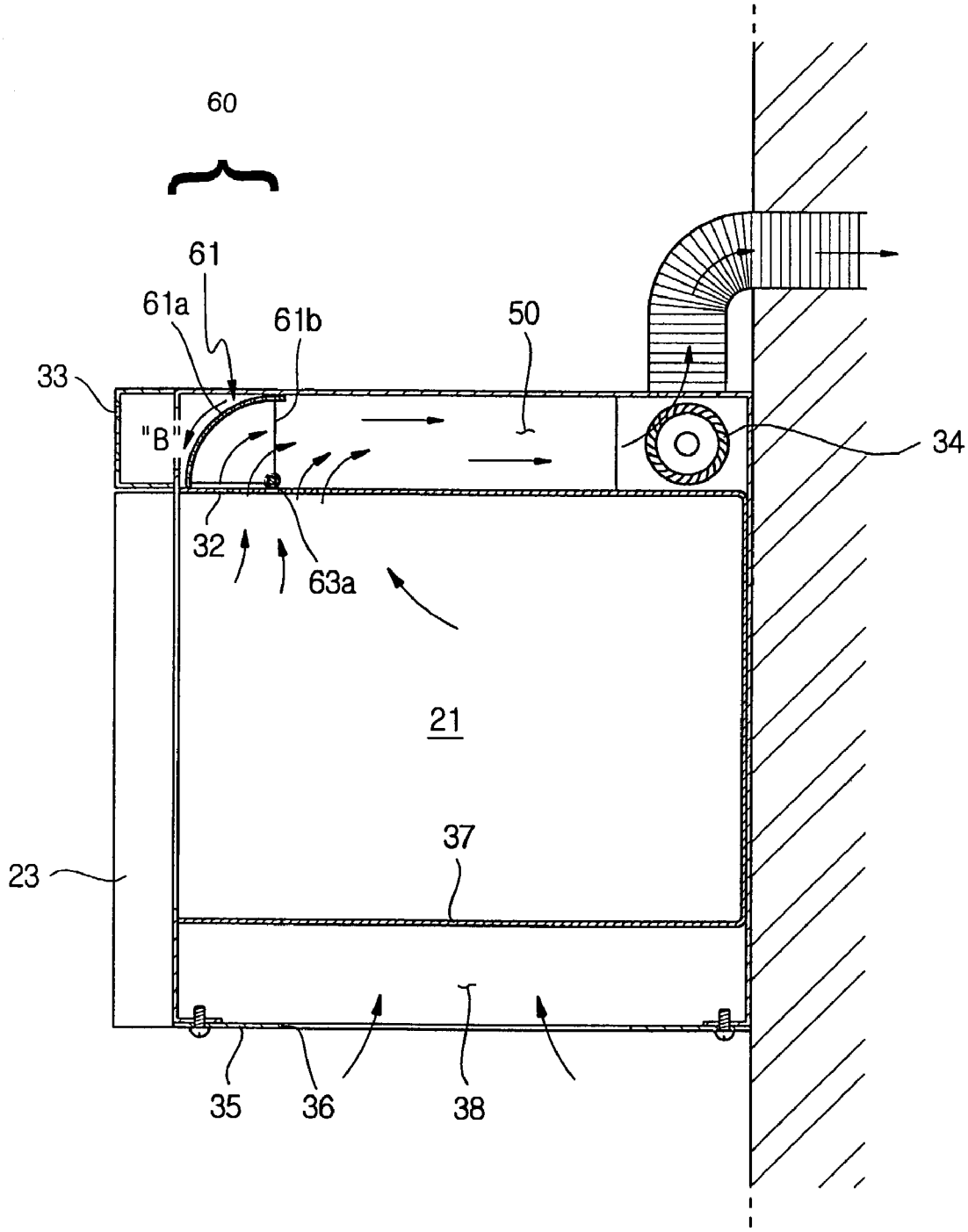
FIG. 6 is a cross sectional view of the wall-mounted type microwave oven shown in FIG. 2 illustrating the air in the cooking chamber being discharged to an exhaust flow path.

FIGS. 5 and 6 illustrate operations of the path converting device 60 to direct and discharge air toward one of the front air outlet 33 and the exhaust fan 34. With reference to FIGS. 2–6, the operations of the path-converting device 60 will be described in detail herein below.

To discharge air in the cooking chamber 21 to the front air outlet 33 during a cooking operation, the vent holes 32 of the cooking chamber 21 is allowed to communicate with the front air outlet 33 by pushing the path-converting switch 70 on the control panel 29.

That is, since the path-converting member 61 is rotated in a direction of arrow "A" by an operation of the drive motor 62, as shown in FIGS. 3 and 5, the communicating flow path 50 between the vent holes 32 and the exhaust flow path is blocked by the path-blocking plate 61*a*, and the vent holes 32 communicate with the front air outlet 33. Accordingly, the air discharged from the cooking chamber 21 through the vent holes 32 is discharged to the outside, i.e., a kitchen room space, through the front air outlet 33.

To discharge odors and gas generated in the cooking chamber 21 to the upper path section 41, the vent holes 32 of the cooking chamber 21 are allowed to communicate with the upper path section 41 by an operation of the path-converting device 60 while the exhaust fan 34 is operated. Accordingly, a ventilation operation through the exhaust flow path is obtained.

That is, since the path-converting member 61 is rotated in a direction of arrow "B" by an operation of the drive motor 62, as shown in FIGS. 3 and 6, a flow path between the vent holes 32 of the cooking chamber 21 and the front air outlet 33 is blocked by the path-blocking plate 61*a*, and the vent holes 32 communicate with the upper path section 41. Accordingly, the air discharged from the cooking chamber 21 through the vent holes 32 is directed to the upper path section 41 and then discharged to the outside, i.e., outside of the kitchen room space, by the exhaust fan 34.

As described above, the present invention provides a wall-mounted type microwave oven which selectively converts a discharging direction of air in a cooking chamber to one of a front ventilation flow path and a rear exhaust flow path, thereby preventing pollution of room air due to odors and gas generated from food in the cooking chamber.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A wall-mounted type microwave oven comprising:

an oven body for mounting in a cooking area, and which includes a cooking chamber and an electrical component compartment which are isolated from each other;

an exhaust flow path isolated from the cooking chamber and the electrical component compartment, which communicates between a lower portion of the oven body and an upper portion of the oven body to exhaust air existing under the oven body to an outside of the cooking area;

a ventilation flow path positioned near a front portion of the microwave oven, which communicates between an inside of the cooking chamber and a front air outlet of the oven body to ventilate the cooking chamber;

a communicating flow path which is provided in the oven body and communicates between the exhaust flow path and the ventilation flow path; and a path-converting device which is provided in the communicating flow path and selectively changes a discharging direction of the air exhausted from the cooking chamber toward one of the front air outlet and the exhaust flow path.

2. The microwave oven as set forth in claim 1, wherein:

the ventilation flow path includes one or more through-holes formed at an upper surface of the cooking chamber, which communicate with the front air outlet, and the communicating flow path is provided over the cooking chamber and allows the front air outlet, the one or more through-holes and the exhaust flow path to communicate with one another.

3. A wall-mounted type microwave oven comprising:

an oven body for mounting in a cooking area, and which includes a cooking chamber and an electrical component compartment which are isolated from each other;

an exhaust flow path which communicates between a lower portion of the oven body and an upper portion of the oven body to exhaust air existing under the oven body to the outside of the cooking area;

a ventilation flow path which communicates between an inside of the cooking chamber and a front air outlet of the oven body to ventilate the cooking chamber;

a communicating flow path which is provided in the oven body and communicates between the exhaust flow path and the ventilation flow path; and a path-converting device which is provided in the communicating flow path and selectively discharges air exhausted from the cooking chamber toward either the front air outlet or the exhaust flow path wherein the ventilation flow path includes one or more through-holes formed at an upper surface of the cooking chamber, which communicate with the front air outlet, the communicating flow path is provided over the cooking chamber and allows the front air outlet, the one or more through-holes and the exhaust flow path to communicate with one another, and the path-converting device comprises:

a path-converting member which is rotatably provided in the communicating flow path, positioned over the one or more through-holes and has a path-blocking sectional area corresponding to a sectional area of the communicating flow path, and a drive motor which rotates the path-converting member in both forward and reverse directions.

4. The microwave oven as set forth in claim 3, wherein the path-converting member comprises:

a path-blocking curved plate having a longitudinal length corresponding to a width of the communicating flow path; and a pair of support portions which extend from corresponding opposite ends of the path-blocking plate toward a rotating axis thereof, so as to have free ends of the support portions be rotatably supported to portions defining the communicating flow path.

5. The microwave oven as set forth in claim 4, wherein a circle depicted by the path-blocking curved plate has a radius which corresponds to a height of the communicating flow path.

6. The microwave oven as set forth in claim 4, wherein the one or more through-holes of the cooking chamber are positioned at an area corresponding to a diameter of the circle depicted by the path-blocking plate.

7. The microwave oven as set forth in claim 3, wherein:

the drive motor is installed outside of the communicating flow path, and the path-converting device further comprises:

a sector gear coupled to a rotating shaft of the path-converting member; and a pinion coupled to a shaft of the drive motor and which engages with the sector gear to reduce a rotational speed of the drive motor and transmit a rotating force of the drive motor to the path-converting member.

8. The microwave oven as set forth in claim 1, further comprising a control panel having a path-converting switch which controls the path-converting device to discharge the air exhausted from the cooking chamber toward either the front air outlet or the exhaust flow path.

9. The microwave oven as set forth in claim 1, wherein the front air outlet ventilates the air exhausted from the cooking chamber to the cooking area.

10. The microwave oven as set forth in claim 1, wherein the ventilation flow path allows air to be introduced into the electrical component compartment and the cooking chamber, and be discharged to the cooking area.

11. The microwave oven as set forth in claim 1, wherein the exhaust flow path comprises:

an intake port formed at a bottom panel of the oven body;

a lower path section which is defined between the bottom panel, and the cooking chamber and the electrical component compartment;

rising path sections provided at corresponding side portions of the oven body and which communicate with the lower path section; and upper path sections provided at corresponding areas of the upper portion of the oven body and which communicate with the corresponding rising path sections.

12. The microwave oven as set forth in claim 1, further comprising a heating unit which cooks food contained in the cooking chamber.

13. The microwave oven as set forth in claim 12, wherein:

the heating unit is a magnetron which is installed in the electrical component compartment and generates microwaves to cook the food, and the microwave oven further comprising a wave guide which guides the microwave from the magnetron to the cooking chamber.

14. The microwave oven as set forth in claim 1, further comprising:

a cooling fan which cools the electrical component compartment, and introduces air into the cooking chamber so as to ventilate the cooking chamber; and an exhaust fan which is installed at the upper portion of the oven body and discharges the air existing under the oven body.

15. A wall-mountable cooking apparatus comprising:

an oven body for mounting in a cooking area;

a cooking chamber provided in the oven body for containing food therein;

a heating unit which cooks the food;

an exhaust flow path provided in the oven body isolated from the cooking chamber, to exhaust air existing under the oven body to the outside of the cooking area;

a ventilation flow path which ventilates air in the cooking chamber to the cooking area;

a communicating flow path which communicates between the exhaust flow path and the ventilation flow path; and a path-converting device positioned in the communication flow path, which selectively changes a discharging direction of air exhausted from the cooking chamber toward one of the ventilation flow path and the exhaust flow path.

16. The cooking apparatus as set forth in claim 15, further comprising a control panel having a path converting switch which controls the path-converting device.

17. The cooking apparatus as set forth in claim 15, wherein the ventilation flow path comprises:

one or more through-holes formed at an upper surface of the cooking chamber; and an air outlet which communicates with the cooking area.

18. A wall-mountable cooking apparatus comprising:

an oven body for mounting in a cooking area;

a cooking chamber provided in the oven body for containing food therein;

a heating unit which cooks the food;

an exhaust flow path provided in the oven body to exhaust air existing under the oven body to the outside of the cooking area;

a ventilation flow path which ventilates air in the cooking chamber to the cooking area;

a communicating flow path which communicates between the exhaust flow path and the ventilation flow path; and a path-converting device which selectively changes a discharging direction of air exhausted from the cooking chamber toward one of the ventilation flow path and the exhaust flow path wherein the ventilation flow path comprises:

one or more through-holes formed at an upper surface of the cooking chamber; and an air outlet which communicates with the cooking area, and the path converting device comprises:

a path-converting member rotatably provided in the communication flow path, positioned over the one or more through-holes and has a path-blocking sectional area corresponding to a sectional area of the communicating flow path, and a drive motor which rotates the path-converting member.

19. The cooking apparatus as set forth in claim 18, wherein the path-converting member rotates in one direction to discharge the air exhausted from the cooking chamber toward the exhaust flow path and rotates in another direction to discharge the air exhausted from the cooking chamber toward the air outlet.

20. The cooking apparatus as set forth in claim 19, wherein:

the path-converting member has a curved shape so as to guide the air exhausted from the cooking chamber to one of the exhaust flow path and the air outlet, and the one or more through-holes of the cooking chamber are positioned at an area corresponding to a diameter of a circle depicted by the path-converting member.

21. A wall-mountable cooking apparatus comprising:

an oven body for mounting in a cooking area;

a cooking chamber for containing food therein;

a heating unit which cooks the food;

a rear exhaust flow path isolated from the cooking chamber, to exhaust air existing under the oven body to the outside of the cooking area;

a front ventilation flow path which ventilates air in the cooking chamber to the cooking area;

a communicating flow path which communicates between the rear exhaust flow path and the front ventilation flow path; and a path-converting unit positioned in the communicating flow path, which selectively changes a discharging direction of air exhausted from the cooking chamber toward one of the front ventilation flow path and the rear exhaust flow path.

* * * * *